United States Patent [19]

Wangkeo et al.

[11] 4,205,406

[45] Jun. 3, 1980

[54] BABY MAGIC SWING CRIB

[76] Inventors: Dusit Wangkeo, c/o George Spector, 3615 Woolworth Bldg., 233 Broadway; George Spector, 3615 Woolworth Bldg., 233 Broadway, both of New York, N.Y. 10007

[21] Appl. No.: 811,694

[22] Filed: Jun. 30, 1977

[51] Int. Cl.[2] ..... A47D 7/00

[52] U.S. Cl. ..... 5/98 R; 5/99 B

[58] Field of Search ..... 5/99, 99 A; 297/127, 297/130; 5/98, 99 B, 101–109, 94; 312/3–6; 248/166, 170, 370

[56] References Cited

U.S. PATENT DOCUMENTS

| | | | |
|---|---|---|---|
| 1,422,619 | 7/1922 | Pomilio | 5/101 |
| 3,041,032 | 6/1962 | Wilcox | 248/170 |
| 3,364,507 | 1/1968 | Anderson | 5/103 |
| 3,454,968 | 7/1969 | Beckman | 5/94 |
| 3,574,872 | 4/1971 | Mattila | 5/99 R |

*Primary Examiner*—Casmir A. Nunberg

[57] ABSTRACT

A crib for an infant which is designed so to swing back and forth in the air; the crib including a basket suspended on chains which are hung from a stationary frame that is readily collapsible so to be conveniently portable.

2 Claims, 5 Drawing Figures

BABY MAGIC SWING CRIB

This invention relates generally to infants' cribs.

A principal object of the present invention is to provide a crib that swings back and forth so to lull the child.

Another object is to provide a swing crib which accordingly eliminates need of a person to sit up and rock a baby to sleep in the middle of the night.

Another object is to provide a swing crib in which the crib comprises a basket suspended to swing from a stationary frame, the basket being made with open mesh or fabric sides so to allow air ventilation therethrough while being fine enough so an infant does not stick a hand or finger outward therethrough, the mesh also allowing a person to see therethrough in order to observe the infant.

Still another object is to provide a swing crib wherein the soft mesh or fabric of the basket eliminates need of any side padding.

Other objects are to provide a Baby Magic Swing Crib which is simple in design, inexpensive to manufacture, rugged in construction, easy to use and efficient in operation.

These and other objects will be readily evident upon a study of the following specification and the accompanying drawings wherein.

Figures 1, 2, 3, 4, 5:
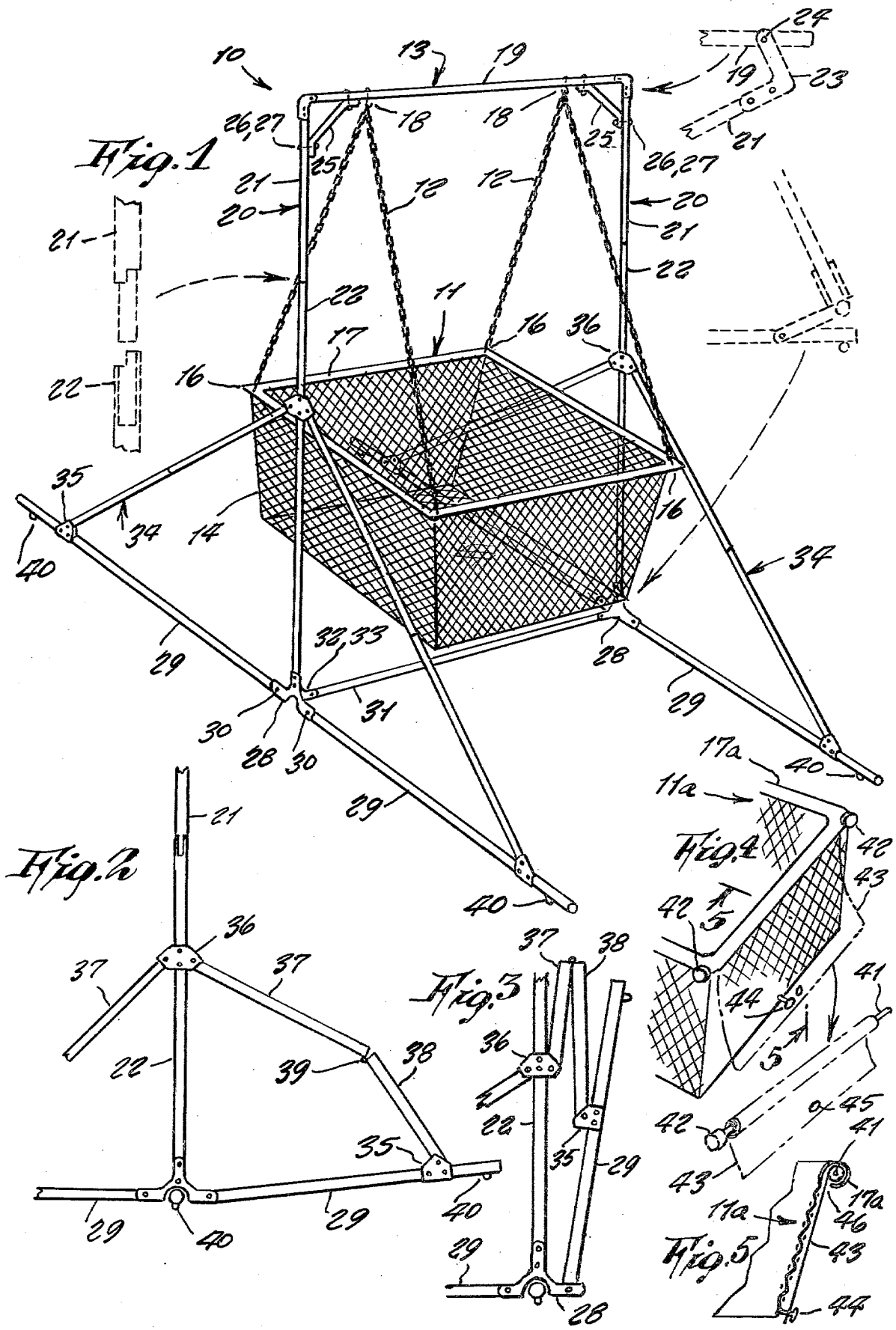
FIG. 1 is a perspective view of the invention shown set up.
FIG. 2 is a fragmentary side view of the supporting frame thereof in erected position.
FIG. 3 is a view thereof shown folded up.
FIG. 4 shows framentarily a modified design of basket.
FIG. 5 is a cross section on line 5—5 of FIG. 4.

Referring now to the drawing in greater detail, and more particularly to FIGS. 1 to 3 thereof at this time, the reference numeral 10 represents a "Baby Magic" Swing Crib according to the present invention wherein the same includes a basket 11 suspended on chains 12 supported from a completely collapsible frame 13.

The basket is made with a soft mesh material or fabric 14 and measures 22 by 40 inches at its bottom, and 24 by 42 at its upper edge. The top of the basket is completely open.

The two chains 12 are each secured at opposite ends to two corners 16 of a top frame 17 of the basket. The center of the chains are hooked on hooks 18 of a cross bar 19 of the frame.

The frame includes two side legs 20 that support the cross bar 19, each leg comprising interfitting upper and lower extendable leg sections 21 and 22. The upper section is secured to an angle bracket 23 that pivots on a pin 24 secured at each end of the crossbar. An angular brace 25 secured with nuts and bolts 26 and 27 firmly hold the legs and cross bar from wobble.

The lower ends of the lower section 22 is affixed to a bracket 28 to which a pair of opposite extending feet 29 are pivotably attached means of pins 30. A foot cross bar 31 is secured between the brackets 28 by means of removable nuts and bolts 32 and 33.

A diagonal brace or stabilizing bar 34 between the outer end of each foot and the leg section 22 steadies the frame from wobble. Brackets 35 and 36 at each end of the brace provide pivotal interconnection between these parts. Each brace comprises sections 37 and 38 hingedly connected by a hinge pin 39.

Rubber pads 40 under the outer ends of the feet 29 and under the foot cross bar 31 cushion the frame on a floor.

The crossbar 19 and foot crossbar 31 are each 46 inches long so the basket can extend lengthwise between the legs 20.

In FIGS. 4 and 5, a modified design of the invention illustrates a basket **11*a* in which top frame 17*a* is rounded and made of semi-soft plastic so to not hurt a child if falling against it. The top frame is hollow, and a rod 41 is enclosed in each straight side of the frame 17*a*, the rod being journalled rotatably outwardly of the interior of the tubular frame so to form a knob 42 that is manually rotatable. A solid polyethylene sheet 43 can then be rolled on the rod, and when pulled down it can lay flat against a side of the meshed wall and prevent draft blowing on the child, particularly on windy days when the device is outside of a home. A hook 44 on the basket engages a hole 45 on the sheet 43 so to hold it rolled down. The sheet is stored inside the tubular frame 17*a* when not needed by unhooking from hook 44 and then rotate the knob 42 so to roll up the sheet through a slot 46 on the frame 17*a***.

While various changes may be made in the detail construction, it is understood that such changes will be within the spirit and scope of the present invention, as is defined by the appended claims.

The following is claimed:

1. A "Baby Magic" swing crib, comprising in combination, a basket, a frame and a pair of chairs, said basket being suspended by said chains from said frame, said basket including a soft mesh side walls all around opposite ends of said chains being secured to corners of a top edge framing a top opening of said basket, and said frame being foldable by being comprised of disengagable and collapsible components, wherein said frame includes a top cross bar to which said chains are booked, a vertical leg supporting each end of said top cross bar, a foot cross bar between lower ends of said legs, said legs being comprised of upper and lower extendable sections, and opposite extending feet pivotally attached between a lower end of each leg being secured by a foldable stabilizing bar therebetween and said legs, wherein said basket has a top frame of hollow tube, each side of said top frame containing a rotatable rod having a solid polyethylene sheet rolled on it, one end of said rod protruding outward of said top frame and having a knob on said end for rotating manually said rod.

2. The combination as set forth in claim 1, wherein said sheet extends outward through a slot on said top frame and is attachable by a hole on said sheet engaging a hook on a lower edge of said basket.

* * * * *